US007637695B1

(12) United States Patent
Akkala

(10) Patent No.: US 7,637,695 B1
(45) Date of Patent: Dec. 29, 2009

(54) HEAVY DUTY TRENCH FRAME AND GRATE ASSEMBLY

(75) Inventor: Steven M. Akkala, Neenah, WI (US)

(73) Assignee: Neenah Foundry Company, Neenah, WI (US)

( * ) Notice: Subject to any disclaimer, the term of this patent is extended or adjusted under 35 U.S.C. 154(b) by 111 days.

(21) Appl. No.: 11/855,674

(22) Filed: Sep. 14, 2007

Related U.S. Application Data

(60) Provisional application No. 60/825,648, filed on Sep. 14, 2006.

(51) Int. Cl.
*E01F 5/00* (2006.01)

(52) U.S. Cl. ..... 405/118; 404/4; 404/2

(58) Field of Classification Search ..... 405/118, 405/119, 124, 126; 404/2, 4
See application file for complete search history.

(56) References Cited

U.S. PATENT DOCUMENTS

| | | | | |
|---|---|---|---|---|
| 4,472,078 | A * | 9/1984 | Karbstein | 405/119 |
| 4,640,643 | A * | 2/1987 | Williams | 405/118 |
| 5,024,550 | A | 6/1991 | Mainville | |
| 5,256,000 | A * | 10/1993 | Beamer | 405/119 |
| 5,613,804 | A * | 3/1997 | Beamer | 405/119 |
| 6,027,283 | A * | 2/2000 | Schweinberg et al. | 405/118 |
| 6,220,784 | B1 * | 4/2001 | Bricker | 405/118 |
| 6,533,497 | B2 * | 3/2003 | Gunter | 405/118 |
| 6,595,720 | B2 * | 7/2003 | Humphries et al. | 405/118 |
| 6,942,419 | B2 | 9/2005 | Knak et al. | |
| 7,048,466 | B2 * | 5/2006 | Benesteau et al. | 405/119 |

FOREIGN PATENT DOCUMENTS

GB 2209783 A * 5/1989

* cited by examiner

*Primary Examiner*—Frederick L Lagman
(74) *Attorney, Agent, or Firm*—Krieg DeVault LLP

(57) ABSTRACT

A frame for retaining a grate over a trench for directing storm water to subterranean basins includes a frame that is embedded in the concrete surrounding the trench. The frame includes a support member, including a vertical support that is sized and dimensioned to abut the wall of the trench, and a horizontal flange that is cantilevered over the trench to receive a grate member. The frame further includes a reinforcement member that runs parallel to the length of the support member, and a plurality of rib members that couple the reinforcement member to the support member. The reinforcement member and rib members are embedded in the pavement adjacent the trench, to provide a back structure for reinforcing the support of the grate.

19 Claims, 5 Drawing Sheets

HEAVY DUTY TRENCH FRAME AND GRATE ASSEMBLY

CROSS-REFERENCE TO RELATED APPLICATION

This application claims priority to U.S. Provisional patent application Ser. No. 60/825,648, filed Sep. 14, 2006.

FIELD OF THE INVENTION

The present invention is directed to a grate assembly for enclosing a drainage trench, and more specifically, to a frame for retaining a grate structure over a drainage trench.

BACKGROUND OF THE INVENTION

Trenches for directing storm water to subterranean basins are commonly found in paved surfaces such as driveways and parking lots, and are typically found across vehicular entrances and interior surfaces of the pavement. To allow for vehicular travel over the trench, these trenches are typically covered by substantial grates or grating systems and assemblies, portions of which are embedded into the surrounding pavement.

Typical trench grate assemblies include two parts: a frame section and a grate section. The frame section comprises a metal component that is positioned over a ledge formed in the pavement along the sides of the trench and is sized and dimensioned to receive the grate. A portion of the frame is typically formed to be received in the pavement surrounding the trench, to anchor the frame in position. The grate provides a surface that can support a vehicle traversing the trench, but includes apertures that allow water and other fluids to flow into the underlying trench. The grate is typically constructed of individual pieces that are laid end to end along the trench to provide an overall grating system of a selected length. Each frame piece typically includes apertures sized and dimensioned to receive threaded fasteners, and the frame pieces are coupled to the frame using a fastener such as a threaded coupling device that extend through the apertures formed in the frame, and into the concrete ledge.

Although these prior art devices provide suitable drainage trench structures, the need for a ledge for mounting the frame limits the size, and particularly the width, of the drainage system that is provided by the frame construction. Additionally, because a corresponding ledge is required in the grate, a significant amount of material is devoted to mounting the drainage system, rather than to providing a useable drainage structure, thereby increasing the cost of the overall trench system. Furthermore, because the frame rests on a concrete ledge, the apertures for receiving fasteners to join the frame and grate members together necessarily rest on the ledge and can become filled with dirt or debris, making it difficult or impossible to properly tighten the fasteners. In addition, prior art trench frames have relatively limited framing for retaining the frame in the concrete, and therefore can be subject to damage when used heavily or subjected to substantial weights. The present invention addresses these problems.

SUMMARY OF THE INVENTION

In one aspect of the invention, a frame for retaining a trench grate over a drainage trench is provided. The frame comprises a support member having a sidewall for alignment along a wall of the drainage trench and an upper and a lower surface, and a substantially horizontal flange extending substantially perpendicular to the sidewall from a point between the upper and lower surfaces for supporting a grate over the drainage trench at a position above a surface of the drainage trench.

In another aspect of the invention, the frame further comprises a reinforcement member offset a distance from a side of the support member opposite the substantially horizontal flange and at least one rib member coupling the support member to the reinforcement member.

In yet another aspect of the invention, a top surface of the rib member is angled downward from a back sidewall of the support member to the top surface of the reinforcement member.

In still another aspect of the invention, the horizontal flange includes an aperture for receiving a threaded fastener for coupling a trench grate to the frame.

In another aspect of the invention, a frame for retaining a trench grate over a drainage trench is provided. The frame comprises a support member, having a length dimension extending along a wall of the drainage trench, and a substantially vertical sidewall for alignment along a substantially vertical wall of the drainage trench. A substantially horizontal flange extends from the sidewall of the support member for supporting a grate in the drainage trench. A reinforcement member, substantially parallel to the length dimension of the support member, is offset a distance from a side of the support member opposite the substantially horizontal flange, and a plurality of rib members spaced along the length of the support member and coupling the support member to the reinforcement member.

In still another aspect of the invention, a drainage trench is provided comprising a trench formed in a concrete pavement structure, the trench having first and second parallel sidewalls, and a bottom surface. A frame is embedded in the concrete pavement structure, and includes a vertical support aligned along a side of each of the first and second parallel sidewalls of the trench, and a substantially horizontal flange extends from each of the vertical supports toward a center of the concrete trench over the bottom surface of the trench. A reinforcement member is embedded in the concrete trench parallel to and offset a distance from the vertical support and embedded in the concrete trench. A plurality of rib members extending between the frame and the reinforcement member are embedded in the concrete surrounding the trench. A grate is received in the frame to cover the trench.

These and other features and characteristics of the present invention will be apparent from the description which follows. In the detailed description below, preferred embodiments of the invention will be described with reference to the accompanying drawings. These embodiments do not represent the full scope of the invention. Rather the invention may be employed in other embodiments, and reference should therefore be made to the claims herein for interpreting the breadth of the invention.

DETAILED DESCRIPTION OF THE PREFERRED EMBODIMENT

Figure 1:
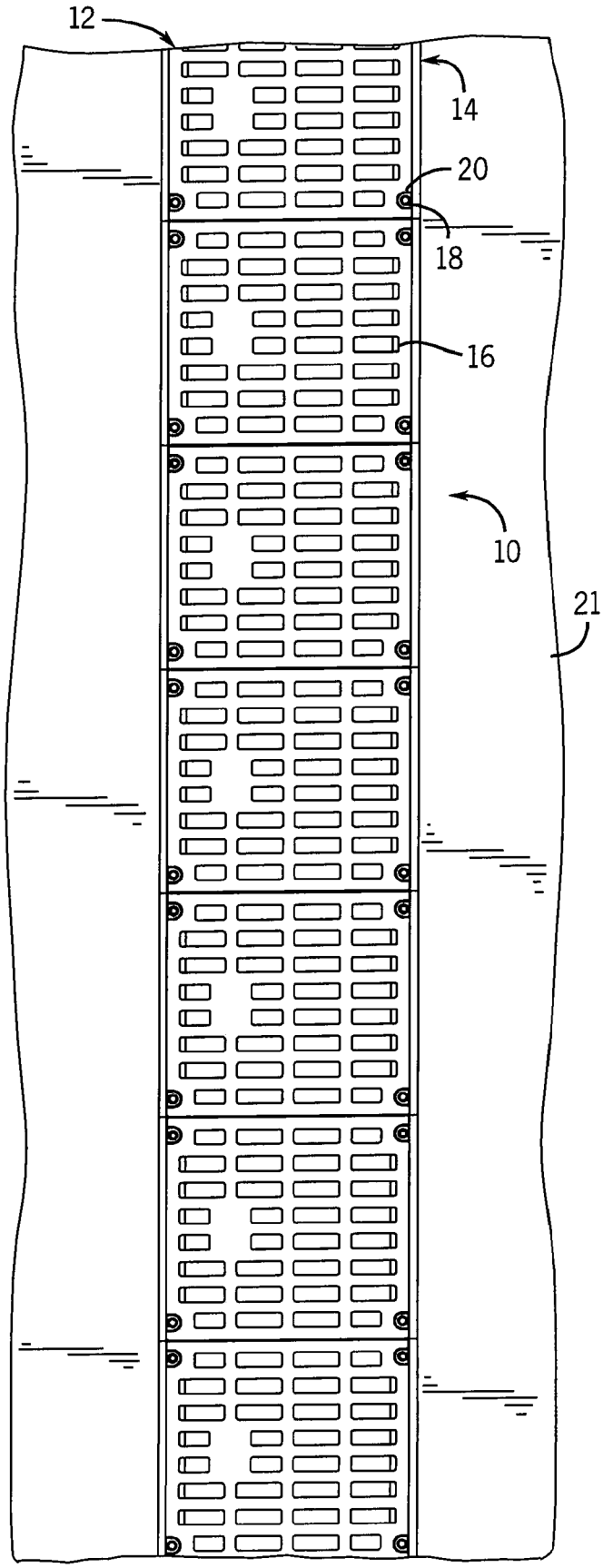
FIG. 1 is a top view of a trench assembly including a frame constructed in accordance with the present invention assembled as part of a drainage trench.

Referring now to the Figures and more particularly to FIG. 1, a top view of a trench grate assembly 10 as assembled over a drainage trench 12 is shown. The trench grate assembly 10 generally comprises a frame 14 and a plurality of grate sections 16. The frame 14 extends along and adjacent the sides of the drainage trench 12, and is embedded in the pavement 21 surrounding the trench 12. The grate sections 16 are aligned end to end over the drainage trench 12 in the frame 14, and each include a plurality of apertures 20, which receive fasteners 18 for retaining the grate sections 16 on the frame 14, as described more fully below. Preferably, as shown here, an aperture 20 is provided adjacent each corner of the grate section 16. Various other methods of securing the grate sections to the frame, including coupling and locking devices, fasteners, and other devices could also be used. The pavement 21 is typically concrete, although various other types of paving materials can also be used, as will be apparent to those of skill in the art.

Figure 2:
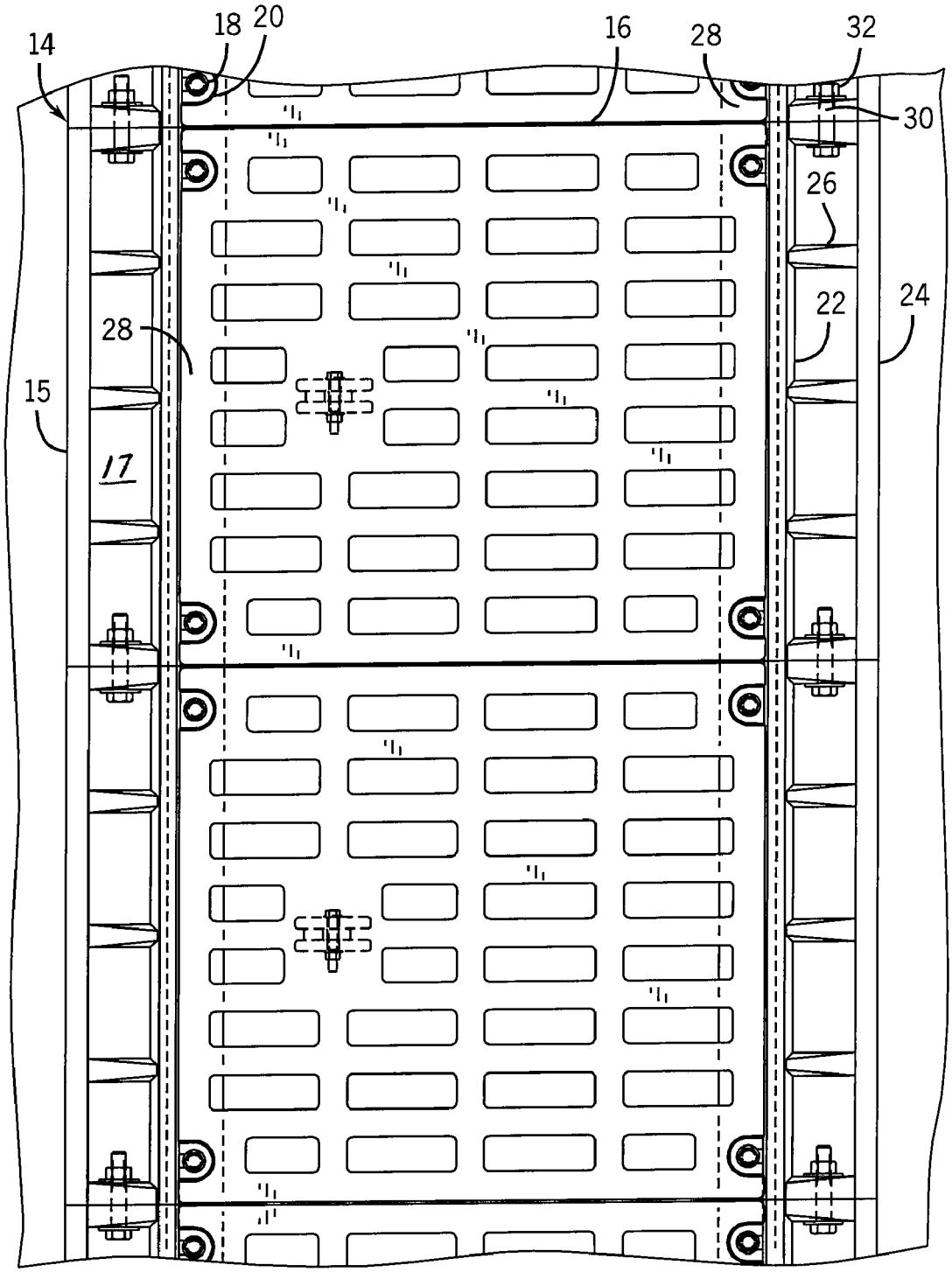
FIG. 2 is a top view of the trench assembly of FIG. 1, illustrating the assembly before paving materials are added to form a drainage trench.
Figure 3:
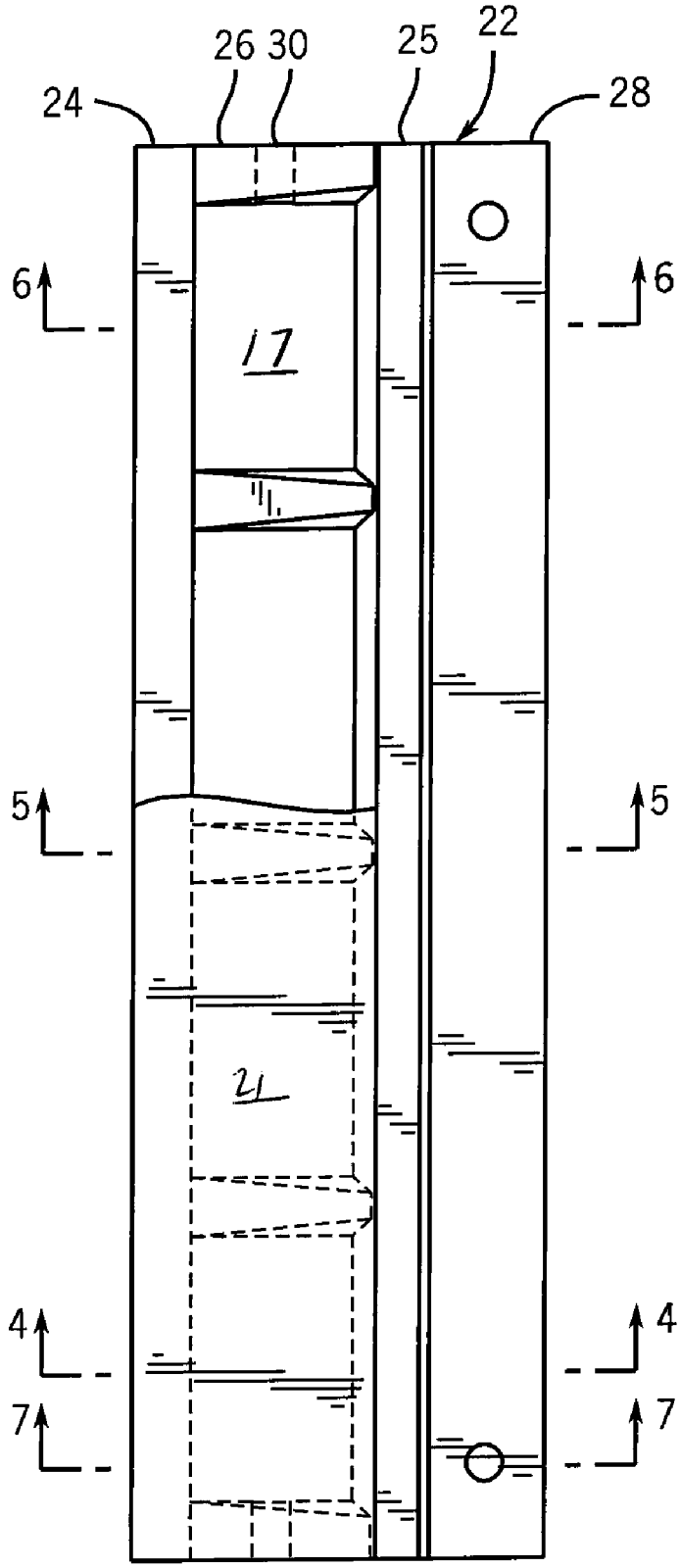
FIG. 3 is a top view of a single frame section, including a portion that is embedded in concrete.
Figure 6:
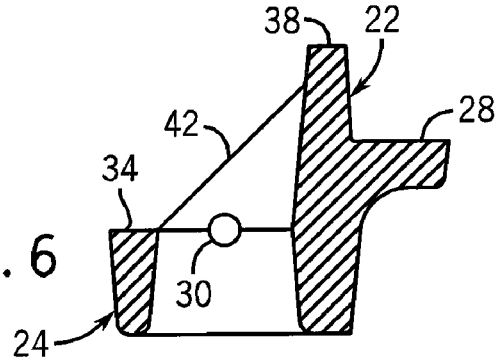
FIG. 6 is a cutaway view of the trench taken along line 6-6 of FIG. 3.

Referring now to FIG. 2, a top view of the trench grate assembly 10 is shown before it is embedded in the pavement 21. The frame 14 comprises a plurality of frame sections 15 that are sized and dimensioned to be aligned along the sides of the drainage trench 12, end to end. Each frame section 15 includes a grate support member 22, a reinforcement member 24 that is parallel to a length of the grate support member 22, and a plurality of spaced rib members 26. The rib members 26 are substantially perpendicular to the length of each of the grate support member 22 and the reinforcement member 24, and connect the grate support member 22 and the reinforcement member 24 together. Referring now also to FIG. 3, from a top view, it can be seen that a space 17 is formed between the support member 22, reinforcement member 24, and adjacent rib member 26. Referring now also to FIG. 6, the rib members 26 provided at opposing ends of the grate support member 22 can include one or more aperture 30 for receiving fasteners 32 for coupling adjacent frame sections 15 together. Although apertures and threaded fasteners are shown here, it will be apparent that various other coupling or locking devices could also be used to join the adjacent frame sections 15.

Figure 4:
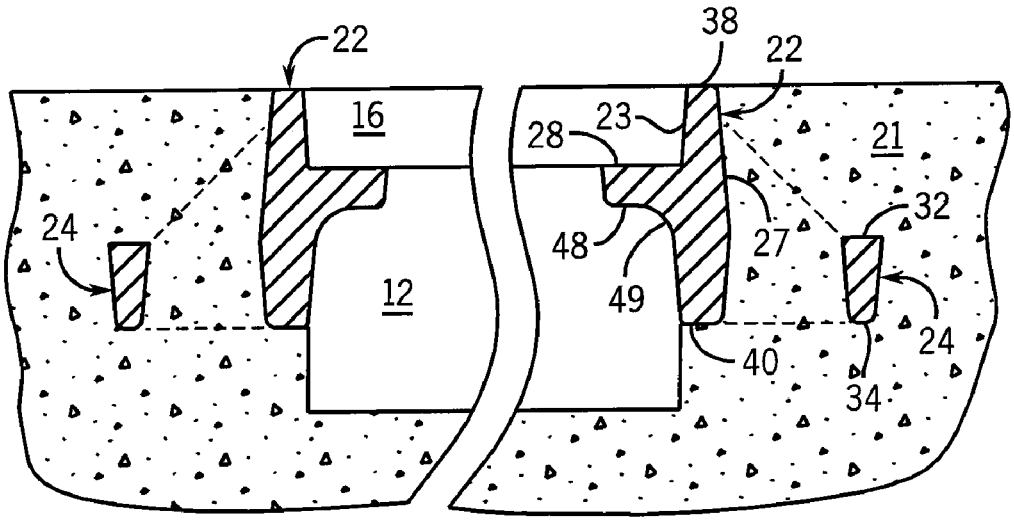
FIG. 4, a cutaway side view of the trench assembly taken along the line 4-4 of FIG. 3.

Referring now also to FIGS. 3-6, a top view of a frame section 15 and cutaway side views taken through the frame section 15 are shown, illustrating the cross sectional construction of the frame section 15 when embedded in pavement 21 surrounding a trench 12. Referring first specifically to FIG. 4, a cutaway view taken along the line 4-4 in FIG. 3 is shown, illustrating a cross section of both the grate support member 22 and the reinforcement member 24. In cross section, the grate support member 22 includes a substantially vertical member 25, including an inner sidewall 23 and an outer sidewall 27 that extend from a top surface 38 that is substantially aligned with the surface of the pavement 21, to a lower surface 40 embedded in pavement 21 in a position adjacent the trench 12. The width of the vertical member 25 between the inner and outer sidewalls 23 and 27 is relatively narrow at the upper surface 38, widens through a center portion of the member 25 and then tapers inward toward the lower surface 40.

Figure 7:
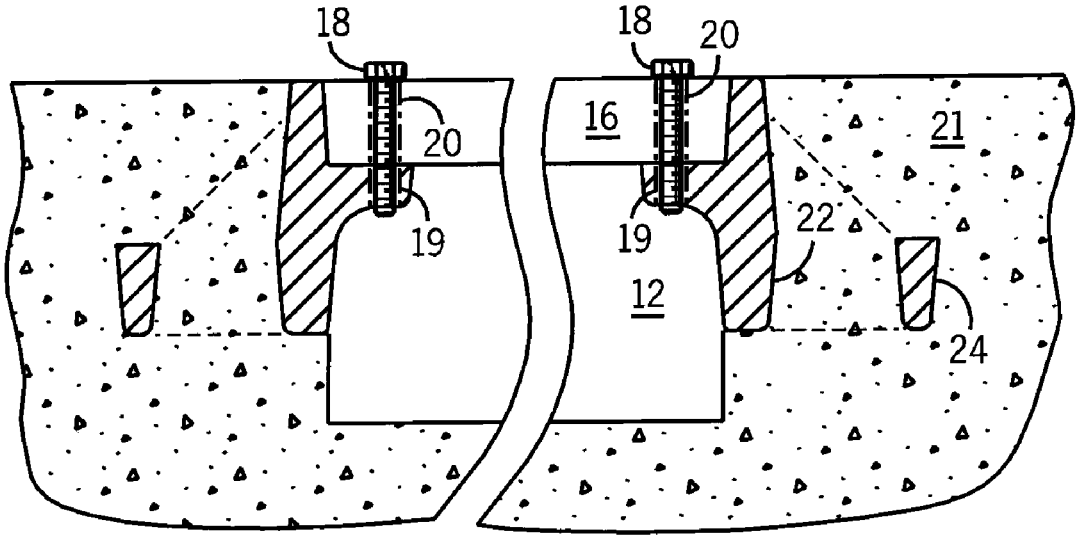
FIG. 7 is a cutaway view of the trench taken along line 7-7 of FIG. 3.

Referring still to FIG. 4, a substantially horizontally-extending flange 28 extends from the vertical member 25, in a direction substantially perpendicular to the vertical member 25, into the interior of the trench 12, and inwardly beyond the trench sidewall to that the space below flange 28 is open. The flange 28 is positioned a distance below the upper surface 38 of the support member 25 selected to be substantially equivalent to the height of a grate section 16 to be received in the frame 14, such that the grate section 16 is aligned with the upper surface 38 of the frame 14 and the surface of the pavement 21 when positioned on the flange 28. The horizontal flange 28 can be, as shown here, substantially centered between the upper surface 38 and lower surface 40 of the vertical member 25. The upper surface 46 of the flange 28 is preferably flat, and generally perpendicular to the sidewall 23 of the vertical member 25, although, as shown here, the sidewall 23 may be angled slightly inward as it approaches the upper surface of the trench 12 to provide a widened opening for receipt of a grate section 16 on the flange 28. The lower surface 48 of the flange 28 includes a substantially horizontal portion and a rounded corner 49 where the flange 28 connects to the vertical support 25, to reinforce the connection between the vertical support 25 and the horizontal flange 28. Referring now also to FIG. 7, the flange 28 provides a cantilevered seat for a corresponding grate section 16. Apertures 19 can be provided in the flange 28 to mate with apertures 20 provided in the grate sections 16, and to receive threaded fasteners 18 or other coupling devices for retaining the grate sections 16 in the frame 14.

Referring still to FIG. 4, in cross-section, the reinforcement member 24 is also vertically oriented, but is substantially lower in height than the support member 22, and is entirely embedded in the pavement 21. As shown here, the reinforcement member 24 is about one third as tall as the support member 22. The lower surface 34 of the reinforcement member 24 is aligned with the and substantially parallel to the lower surface 40 of the support member 22.

Figure 5:
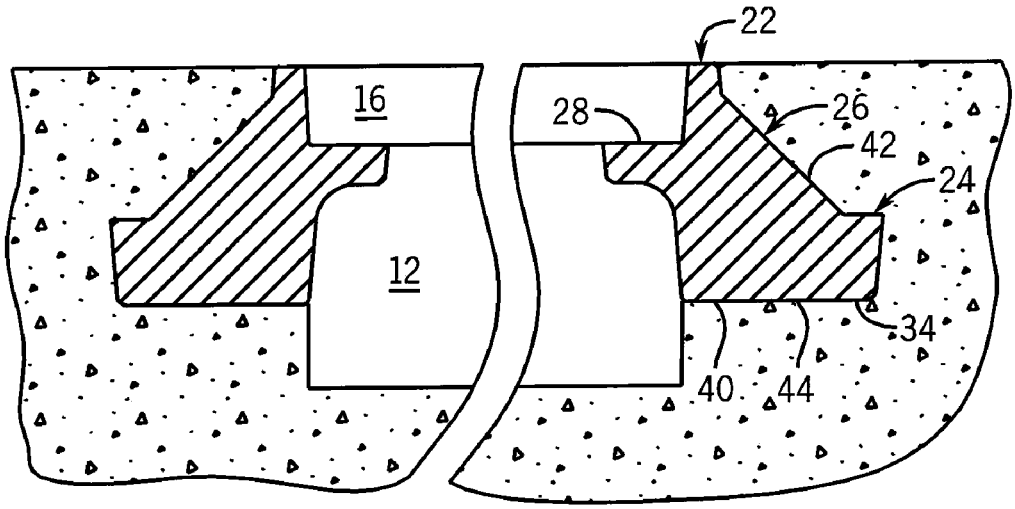
FIG. 5, a cutaway view of the trench taken along line 5-5 of FIG. 3.

Referring again to FIG. 3 and also to FIG. 5, a cross sectional view taken through a rib member 26 is shown. As described above, rib members 26 are spaced along the frame section 15, and extend between the reinforcement member 24 and grate support member 22, joining the reinforcement member 24 to the grate support member 22. The rib members 26 include an angled upper surface 42 that extends between the upper surface 32 of the reinforcement member 24, and the outer sidewall 27 of the vertical support 25 of the grate support member 22, where the rib member 26 is coupled to the grate support member 22 at a position near the upper surface 38. The lower surface 44 of the rib member 26 extends continuously between the lower surface 40 of the grate support member 22 and the lower surface 34 of the reinforcement member 24, such that the rib member 26 substantially encloses the space between the reinforcement member 24 and grate support member 22, providing a solid reinforcement and back structure for reinforcing the frame 14 and supporting the grate sections 16 in the frame 14. In one embodiment of the invention, the upper surface 42 of the rib member 26 is angled at an angle of substantially one hundred and thirty five degrees with respect to the upper surface 32 of the reinforcement member 24. This angle, however, is not critical to the invention and various other angles could also be used. As described above, the support member 22, the reinforcement member 24, and the rib members 26 define generally rectangular spaces between them. Concrete or other pavement materials 21 can flow into these spaces and set, thereby securely anchoring the frame 14 in the pavement.

Referring again to FIG. 2, to construct a drainage trench 12 including a frame 14 and trench grate assembly 10 as described above, a wood frame for forming trench 12 in the pavement 21 is typically provided (not shown). The frame 14 is then assembled along the edge of the wood framing by aligning a plurality of frame sections 15 end to end along a side of the trench 12. The frame sections 15 can then be coupled together by inserting threaded fasteners 32 through apertures 30 in adjacent frame sections 15. Rebar or other reinforcement devices can be threaded through the space between the support member 22 and the reinforcement member 24 and coupled to framing or other elements for constructing the trench 12. For example, U-shaped rebar components can be provided over the sections of the reinforcement member 24 between adjacent rib members 26. After the frame 14 is assembled, pavement 21 such as concrete or other suitable material is poured around the frame 14 and associated framing members, providing a trench 12 with the frame 14 embedded as shown in FIGS. 4 and 5. As described above, the pavement 21 can flow through the space between the support member 22 and reinforcement member 24 between rib members 26 to encase the frame 14 within the pavement, providing a frame with substantial structural integrity.

After the trench 21 and frame 14 are constructed, grate members 16 are inserted into the frame 14. The apertures 20 in the grate members 16 are aligned with mating apertures in the horizontal flange 28, and threaded fasteners 18 or other coupling devices are inserted through the aligned apertures to couple the grate members 16 to the frame 14. The reinforcement member 24 and rib members 26 provide a back structure for supporting the weight of the grate 16 in the frame without the need for a concrete ledge as required in prior art devices. Because the flange 28 is cantilevered over the trench, the area immediately below the flange 28 is open, rather than enclosed with concrete. Therefore, the trench has a larger surface area than prior art trenches. Furthermore, because the area immediately below the flange 28 is open, dirt and debris falls through the apertures 19 in the frame 14, rather than collecting in the apertures, as in the prior art. Because the apertures remain open, the insertion of fasteners into the apertures is easier than in prior art devices, and is not impeded by dirt and debris collected in the frame. Additionally, because the frame structure is substantially embedded in concrete, and easily anchored with rebar components, a frame of substantially greater structural integrity can be achieved. This structure integrity is further increased through the use of fastening elements, such as the threaded fasteners 32 which connect adjacent frame sections.

Although a preferred embodiment of the invention has been described in considerable detail above, many modifications and variations to the preferred embodiment described, however, will be apparent to a person of ordinary skill in the art. In order to apprise the public of the various embodiments that may fall within the scope of the invention, the following claims are made.

I claim:

1. A frame for retaining a trench grate over a drainage trench, the frame comprising:

a support member having a sidewall for alignment along a wall of the drainage trench and an upper and a lower surface;

a substantially horizontal flange extending substantially perpendicular to the sidewall at a point between the upper and lower surfaces of the support member for supporting a grate over a drainage trench at a position above a surface of the drainage trench;

a reinforcement member offset a distance from a side of the support member opposite the substantially horizontal flange, wherein a bottom surface of the support member and a bottom surface of the reinforcement member are horizontally aligned; and at least one rib member coupling the support member to the reinforcement member.

2. The frame as defined in claim 1, wherein the distance between an upper surface of the flange and the upper surface of the support member is selected to be substantially equivalent to the height of a grate to be received in the frame.

3. The frame as defined in claim 1, wherein the upper surface of the sidewall of the support member is substantially horizontal.

4. The frame as defined in claim 1, wherein a distance between the bottom surface of the support member and a top surface of the support member is greater than a distance between the bottom surface of the reinforcement member and a top surface of the reinforcement member.

5. The frame as defined in claim 4, wherein a top surface of the rib member is angled downward from a back sidewall of the support member to the top surface of the reinforcement member.

6. The frame as defined in claim 5, wherein the upper surface of the rib member is angled at an angle of substantially one hundred and thirty five degrees with respect to the upper surface of the reinforcement member.

7. The frame as defined in claim 1, wherein each of the support member and the reinforcement member are elongate along a side of the drain trench, and the at least one rib member includes a plurality of spaced rib members that couple the support member to the reinforcement member.

8. The frame as defined in claim 1, wherein the horizontal flange includes an aperture for receiving a threaded fastener for coupling a trench grate to the frame.

9. The frame as defined in claim 1, wherein the flange is configured to extend inwardly beyond an edge of the drainage trench.

10. A frame for retaining a trench grate over a drainage trench, the frame comprising:

a support member having a sidewall for alignment along a wall of the drainage trench and an upper and a lower surface;

a substantially horizontal flange extending substantially perpendicular to the sidewall at a point between the upper and lower surfaces of the support member for supporting a grate over a drainage trench at a position above a surface of the drainage trench;

a reinforcement member offset a distance from a side of the support member opposite the substantially horizontal flange, wherein each of the support member and the reinforcement member are elongate along a side of the drain trench; and a plurality of spaced rib members coupling the support member to the reinforcement member, wherein the plurality of spaced rib members include a rib member disposed at each of a first end of the frame and at a second end of the frame and the rib members at the first and second ends of the frame include apertures for receiving fasteners for coupling adjacent frame members together.

11. A frame for retaining a trench grate over a drainage trench, the frame comprising:

a support member having a sidewall for alignment along a wall of the drainage trench and an upper and a lower surface;

a substantially horizontal flange extending substantially perpendicular to the sidewall at a point between the upper and lower surfaces of the support member for supporting a grate over a drainage trench at a position above a surface of the drainage trench;

reinforcement member offset a distance from a side of the support member opposite the substantially horizontal flange; and at least one rib member coupling the support member to the reinforcement member, further comprising a space provided between the support member, the reinforcement member, and the at least one rib member, wherein concrete can flow through the space to embed the frame in the trench.

12. A frame for retaining a trench grate over a drainage trench, the frame comprising:

a support member, having a length dimension extending along a wall of the drainage trench and a substantially vertical sidewall for alignment along a substantially vertical wall of the drainage trench;

a substantially horizontal flange extending from the sidewall of the support member and inwardly over and edge of the drainage trench for supporting a grate in the drainage trench;

a reinforcement member offset a distance from a side of the support member opposite the substantially horizontal flange, the reinforcement member being substantially parallel to the length dimension of the support member; and a plurality of rib members spaced along the length of the support member and coupling the support member to the reinforcement member, wherein a lower surface of the support member is substantially aligned with a lower surface of the reinforcement member, and the upper surface of the support member is offset a distance above the upper surface of the reinforcement member.

13. The frame as recited in claim 12, wherein an upper surface of the rib member extends at an angle from a sidewall at the back of the support member to an upper surface of the reinforcement member.

14. The frame as recited in claim 12, further comprising a plurality of apertures formed in the flange for receiving fasteners for coupling a grate section to the flange.

15. The frame as defined in claim 12, further comprising a space provided between the support member, the reinforcement member, and at least one of the plurality of rib members, wherein concrete can flow through the space to embed the frame in the trench.

16. A drainage trench, comprising:

a concrete trench comprising first and second parallel sidewalls, and a bottom surface;

a frame embedded in the concrete structure, the frame including:

a vertical support aligned along a side of each of the first and second parallel sidewalls and a substantially horizontal flange extending from each of the vertical supports toward a center of the concrete trench over the bottom surface of the trench;

a reinforcement member parallel to and offset a distance from the vertical support and embedded in the concrete trench; and a plurality of rib members extending between the frame and the reinforcement member and embedded in the concrete trench; and a grate received in the frame.

17. The drainage trench of claim 16, wherein the frame comprises a plurality of aligned frame sections, each frame section including at least one aperture for receiving a coupling device for coupling a first frame section to a second frame section.

18. The drainage trench of claim 16, wherein the horizontal flange extends inwardly beyond an edge of the drain trench and includes apertures for receiving coupling devices for fastening the frame to the grate.

19. The frame as defined in claim 16, further comprising a space provided between the support member, the reinforcement member, and at least one of the plurality of rib members, wherein concrete can flow through the space to embed the frame in the trench.

* * * * *